US008163231B2

(12) United States Patent
Goutière et al.

(10) Patent No.: US 8,163,231 B2
(45) Date of Patent: Apr. 24, 2012

(54) APPARATUS AND A METHOD FOR TAPPING METAL

(75) Inventors: Vincent Goutière, St-Fulgence (CA); Jean Côté, Jonquiere (CA)

(73) Assignee: Rio Tinto Alcan International Ltd., Montreal, Quebec (CA)

( * ) Notice: Subject to any disclaimer, the term of this patent is extended or adjusted under 35 U.S.C. 154(b) by 1210 days.

(21) Appl. No.: 11/926,205

(22) Filed: Oct. 29, 2007

(65) Prior Publication Data

US 2008/0105554 A1 May 8, 2008

Related U.S. Application Data

(60) Provisional application No. 60/864,325, filed on Nov. 3, 2006.

(51) Int. Cl.
*F16L 9/02* (2006.01)
*C25C 3/06* (2006.01)

(52) U.S. Cl. ..... 266/227; 138/109; 204/279; 205/367; 205/372

(58) Field of Classification Search ..... 15/246.2; 138/109; 204/245, 279, 275.1; 266/44, 165, 266/166, 227, 236; 426/85
See application file for complete search history.

(56) References Cited

U.S. PATENT DOCUMENTS

| | | | | |
|---|---|---|---|---|
| 3,732,948 | A | 5/1973 | Benton et al. | |
| 4,460,440 | A | 7/1984 | McGeer | |
| 5,980,670 | A * | 11/1999 | Andre | 138/109 |
| 6,817,382 | B2 * | 11/2004 | Tanaka et al. | 138/109 |

FOREIGN PATENT DOCUMENTS

| | | |
|---|---|---|
| CA | 1072042 | 2/1980 |
| CA | 1175779 | 10/1984 |

OTHER PUBLICATIONS

International Search Report, PCT/CA2007/001914, dated Feb. 7, 2008.
Marcus L. Walker, Visualisation of Tapping Flows, Light Metals 1997, pp. 215-219, The Minerals, Metals & Materials Society, Melbourne, Australia.

* cited by examiner

*Primary Examiner* — Keith Hendricks
*Assistant Examiner* — Steven A. Friday
(74) *Attorney, Agent, or Firm* — Banner & Witcoff, Ltd.

(57) ABSTRACT

An apparatus and a method for tapping molten metal from below a molten electrolyte layer less dense than the metal is described. The apparatus comprises a pipe comprising a protruding enlarged wall portion at an operative end which is immersed in the molten electrolyte and metal during tapping operation. The enlarged wall portion helps to minimize entrainment of electrolyte residue from the electrolyte/metal interface during tapping. The orientation of the enlarged wall portion may be in the general direction of the crucible.

11 Claims, 8 Drawing Sheets

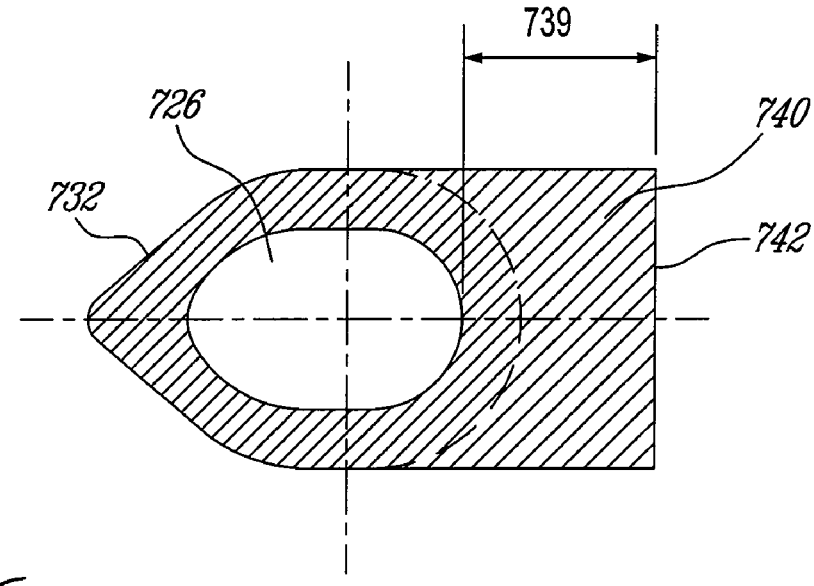
Fig. 4(d)(i)
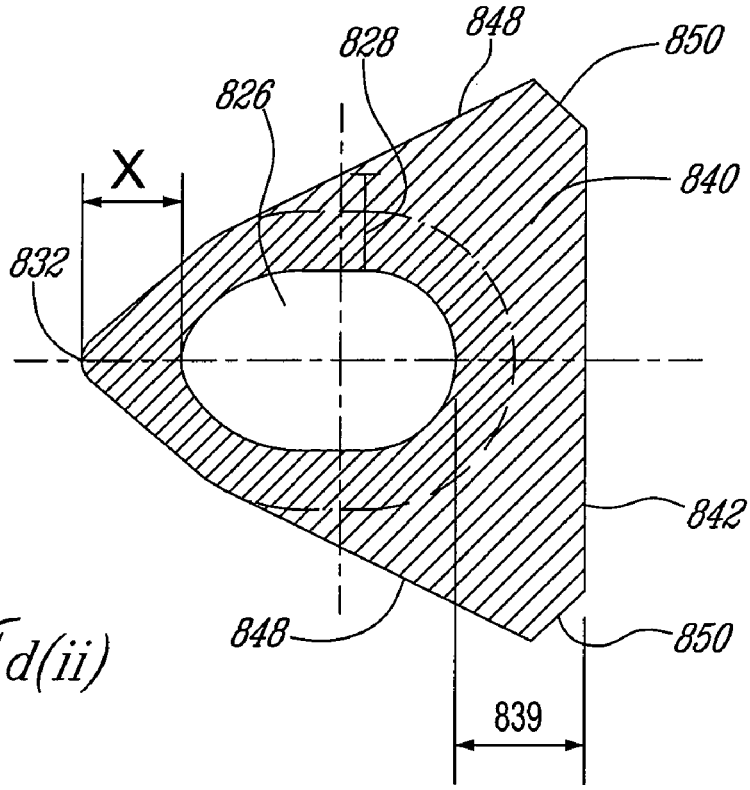
Fig. 4d(ii)

APPARATUS AND A METHOD FOR TAPPING METAL

BACKGROUND OF THE INVENTION

1. Technical Field

The invention relates to tapping metal through an electrolyte layer which is lighter than the metal, and particularly, where the metal is aluminum.

2. Description of the Prior Art

Aluminum is typically produced in electrolytic cells operated at currents of up to 300,000 amps or more, between carbon anodes and a carbon cathode. The carbon cathode forms the floor of a container with sidewalls of carbon or refractory, surrounded by insulation and contained within a steel shell. Within the container is a lower layer or pool of molten aluminum on the carbon cathode floor and an upper less dense layer of molten electrolyte (sodium/aluminum/fluoride salt) lying on top of the aluminum, thus the layers form a liquid-liquid interface between the upper and lower layers. The sidewalls generally are covered with a layer of frozen electrolyte which can extend down and cover the outer periphery of the cathode surface. The exposed top surface of the electrolyte is generally covered by a crust which comprises a mixture of electrolyte and aluminum. The carbon anodes are immersed in the electrolyte and are positioned with their bottom faces a few centimeters (typically less than 5 cm) from the electrolyte metal interface. The molten aluminum layer is typically between 12 and 20 cm. thick, and the electrolyte layer is typically about 20 cm. thick. During operation, alumina is dissolved in the electrolyte and is electrolyzed by direct current flowing from the anodes to the cathode to form more aluminum at the molten metal surface.

The density of the electrolyte is only slightly less than that of the molten aluminum and the interface between the electrolyte and the molten aluminum is relatively unstable and can easily be disturbed.

The metal produced in the electrolytic cell is periodically tapped or withdrawn from the metal pool by inserting a hollow metal pipe, usually fabricated in cast iron, through the electrolyte layer into the metal pool. This pipe or tube is operatively and pneumatically connected to a collecting or tapping crucible. A vacuum is applied in the gas phase of the crucible and this vacuum pulls the metal produced in the cell into the crucible through the pipe where the metal is collected. The metal pipe is often referred to as the "tapping siphon". The operative end immersed in the electrolyte and metal is often called the "siphon tip". It should be noted that although the term siphon is used, the action of withdrawing the metal from the electrolytic cell is due to the application of a vacuum in the gas phase of the crucible and is not due to the action of a siphon. When metal is tapped from a cell, an amount based on a predefined target is removed. The target is based on the estimated metal production rate between tapping operations. Typically the tapping crucible is designed with a capacity sufficient to permit tapping several cells (such as three or four cells) and thus the metal from these cells is mixed in the tapping crucible. When the tapping crucible is full, it can be emptied into a holding furnace which can contain the contents of a number of tapping crucibles. In some operations, metal may be transferred first to an intermediate crucible before transferring to the holding furnace.

Due to the rather shallow depth of the metal pool in the electrolytic cell, a problem arises if the molten metal is not withdrawn carefully. If sufficient care is not taken, electrolyte from the electrolyte/metal interface may be withdrawn along with the metal into the tapping crucible. This electrolyte causes deposits in the crucible and contamination in the holding furnace fed from the tapping crucible. "*Visualization of Tapping Flows*", by M. L. Walker, *Light Metals, The Minerals, Metals and Material Society*, edited by Reidar Huglen, pages 115 *to* 219, 1997, describes a study of the effect of the suction rate on the electrolyte/metal interface.

Walker describes tests done in a "water model", where the electrolyte and the metal in an electrolytic cell are simulated by immiscible liquids having appropriate densities. In this particular study, the two layers were quiescent (not circulating or flowing). By inserting a hollow pipe below the interface between the liquids and withdrawing liquid, Walker concludes that increasing the flow velocity in the hollow pipe causes the interface to be drawn downwards where it eventually was drawn into the pipe interior. From this study, Walker concluded that increasing the flow velocity in the pipe caused "entrainment" of the material above the interface, and therefore in a real electrolytic cell would cause electrolyte to be drawn into the pipe used to tap the electrolytic cell thereby contaminating the metal being tapped. The contact of electrolyte being thus drawn into the pipe with the metal and adjacent cathode floor tends to erode the cathode floor. Walker proposes increasing the interior cross-section of the bore of the pipe placed within the metal, generally expanding the normal circular cross-section bore to an elongated elliptical shape. This is intended to reduce the metal flow velocity as it enters the bore in the pipe to reduce the tendency to draw electrolyte into the pipe. However, this requires an enlarged opening in the tapping pipe which is more difficult to use industrially. Furthermore, the solution is based on a "quiescent" metal and electrolyte layer, which is not representative of real cell operations.

It has been found that a further problem during withdrawal of metal is that the amount of entrained bath varies widely from cell to cell and even on subsequent removals from the cell. This may be caused by many factors including variability of metal depths, location of freeze, and presence of sludge. In some cases, more entrained bath may be present at low removal rate than at high removal rates. Therefore, simply reducing the rate of removal is not an effective solution to the problem.

SUMMARY OF THE INVENTION

It is an aim of the present invention to provide an apparatus for tapping metal from below a layer of less dense electrolyte which reduces the entrainment of electrolyte into the metal.

It is a further aim of the present invention to provide a novel method for tapping a metal from below a lighter electrolyte.

Aspects of the invention can provide an apparatus and method that permits a predictable and controllable level of electrolyte entrainment as well as an overall reduction in the entrainment.

In accordance with an aspect of the invention there is provided an apparatus for tapping molten metal from below a molten electrolyte less dense than the molten metal, the molten metal and the molten electrolyte forming a boundary at an electrolyte/metal interface, the apparatus comprising: a pipe having a first end and a second end opposite the first end, the second end adapted for immersion into the molten metal, the pipe defining an internal bore extending along a length thereof between the first end and the second end the internal bore for passage of molten metal therethrough, the pipe having an enlarged wall portion proximate the second end, the enlarged wall portion extending radially outwardly from the bore in at least one direction and extending axially away from the second end a predetermined distance, a front wall portion opposite the enlarged wall portion, the front wall portion having a first wall thickness, the enlarged wall portion having a second wall thickness greater than the first wall thickness, the second wall thickness being defined from the internal bore to a trailing edge and wherein the second thickness is greater than 1.5 times the first thickness, whereby during tapping the enlarged wall portion traverses the electrolyte/metal interface and defines an obstacle to limit entrainment of electrolyte into the pipe.

In accordance with another aspect of the invention, there is provided a method for tapping a molten metal from below a molten electrolyte less dense than the molten metal into a molten metal receiver, the metal and electrolyte forming a boundary at an electrolyte/metal interface, the method comprising: providing an apparatus comprising a pipe in fluid communication with the molten metal receiver, the pipe having an enlarged wall portion proximate one end, the enlarged wall portion extending radially outwardly from the pipe in at least one direction and extending axially away from the one end a predetermined distance; immersing the one end of the pipe in molten metal contained in an electrolytic cell; positioning the enlarged wall portion such that the enlarged wall portion traverses the electrolyte/metal interface extends towards a wall of an electrolytic cell; and tapping the molten metal by producing a vacuum pressure in the molten metal receiver sufficient to draw the molten metal through the pipe, wherein the enlarged wall portion disrupts the entry of molten electrolyte into the molten metal during tapping.

BRIEF DESCRIPTION OF THE DRAWINGS

Further features and advantages of the present invention will become apparent from the following detailed description, taken in combination with the appended drawings, in which:

FIG. 4(*b*) represents a cross-sectional area of the operative end of the pipe along line 4-4 according to another embodiment of the present invention including an eccentric bore and a wide enlarged wall portion;

FIG. 4(*c*) represents a cross-sectional area of the operative end of the pipe along line 4-4 according to a further embodiment of the present invention including a circular projecting wall and an elliptical enlarged wall portion including a bore centered at the intersection of the major and minor axes of the elliptical cross section;

FIG. 4(*d*)(*i*) represents a cross-sectional area of the operative end of the pipe along line 4-4 according to still another embodiment of the present invention including and a projecting front wall, an elliptical bore and an enlarged rear wall having substantially the same breadth as the pipe outer dimension at the minor axis of the ellipse;

FIG. 4(*d*)(*ii*) represents a cross-sectional area of the operative end of the pipe along line 4-4 according to yet another embodiment of the present invention including a projecting front wall, an elliptical bore and a rear enlarged wall portion extending outward from the pipe wall such that the enlarged wall portion breadth is greater then the outer diameter of the pipe at the minor axis of the ellipse and the cross section is substantially in the shape of a triangle;

FIG. 5(*b*) is a graph of the amount of the electrolyte residue entrained (kg/tonne) for various metal tapping flowrates using a tapping pipe according to one embodiment of the present invention; and, FIG. 6 is a graph comparing an average amount of electrolyte entrained (kg/tonne) at different tapping flowrates (kg/s) for a conventional tapping pipe and a tapping pipe according to FIG. 3 of the present invention.

DETAILED DESCRIPTION OF THE PREFERRED EMBODIMENT

An electrolytic cell producing aluminum is known to have a metal circulation, driven by electromagnetic forces. Each electrolytic cell has a slightly different circulation pattern that is affected by many factors. However, generally the metal is tapped at a location where the circulating metal flow is moving towards the wall adjacent the location where the tapping crucible can have access to the cell, and thus circulating metal flow is towards the crucible itself.

Figure 1:
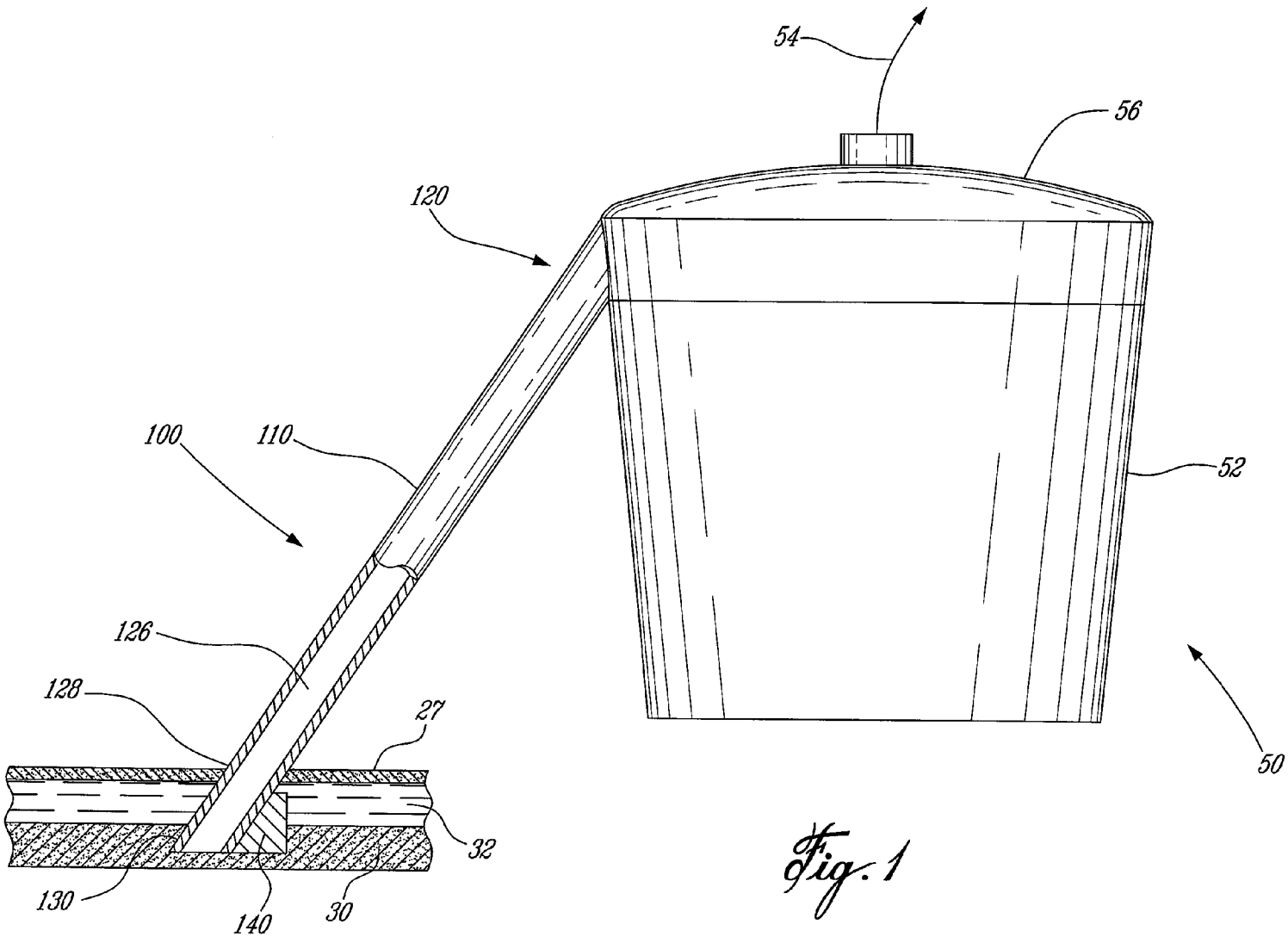
FIG. 1 is a schematic side view representation of a tapping crucible including a partly sectioned apparatus in accordance with an illustrative embodiment of the present invention, the partial section is of a suction end of the apparatus immersed in electrolyte and molten metal.

FIG. 1 illustrates a schematic side view of a molten metal receiver which in an illustrative embodiment is a tapping crucible 50. The crucible includes a metal collection vessel 52, and a vessel top 56, the crucible is designed to withstand a vacuum, normally drawn from a hole in the top 56. The direction of the suction applied is represented by arrow 54.

The crucible 50 is operatively and hydraulically connected to a metal tapping siphon apparatus 100. The siphon apparatus 100 is immersed at a location near a side wall 10 of an electrolytic cell (shown in FIG. 2). The siphon apparatus 100 of the present invention is an elongate pipe 110 requiring appropriate connecting means to the crucible 50. The pipe 110 has a first end or a vacuum end 120 adjacent to and connected operatively and in fluid communication to the gaseous phase of the tapping crucible 50. The pipe 110 includes a second end or a suction end 130 opposite the vacuum end 120 which includes an enlarged wall portion 140 which is adapted to break a frozen electrolyte and alumina crust 27 and for immersion in molten electrolyte 32 and molten metal 30. The enlarged wall portion 140 is located proximate the suction end 130, and extends radially from a central bore 126. In an illustrative embodiment, the pipe is positioned so that the enlarged wall portion extends towards the crucible 50, or in a tapping direction.

It will be understood that the pipe 110 includes a tubular wall 128 defining an internal bore or hole 126 extending from the suction end 130 to the vacuum end 120. The metal is tapped by applying a vacuum into the crucible 50. The vacuum produced must be sufficient to withdraw (or tap) the molten metal 30 upwards from the electrolytic cell through the internal bore 126 into the crucible 50. The crucible 50 then moves on to another electrolytic cell and repeats the tapping operation.

Figure 2:
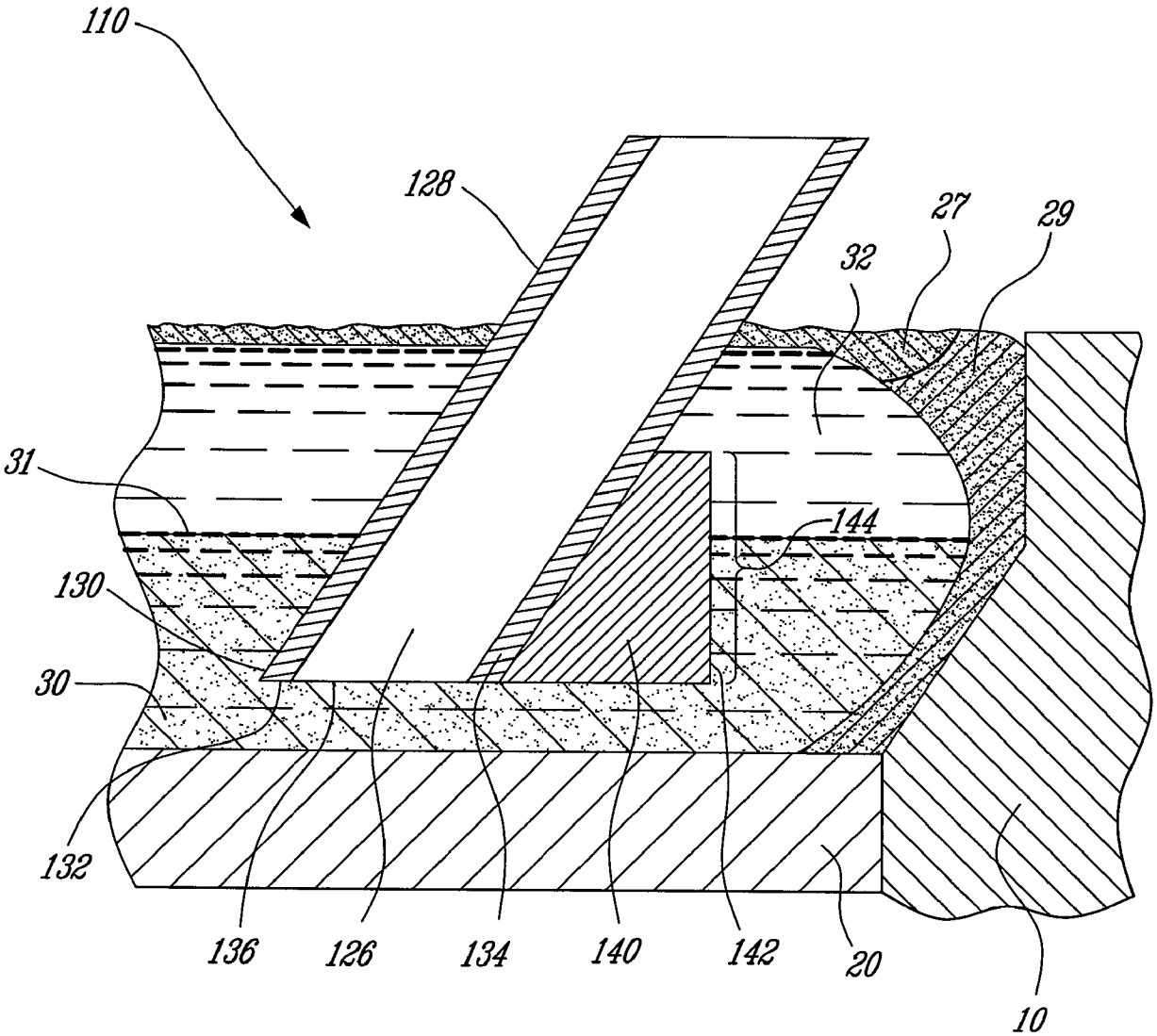
FIG. 2 is an enlarged sectional side view of the suction end of the apparatus in accordance with FIG. 1, immersed in electrolyte and molten metal within an electrolytic cell schematically represented in cross section.

An enlarged sectional side elevation of the suction end 130 immersed in molten electrolyte 32 and molten metal 30 is illustrated in FIG. 2. The pipe 110, the suction end 130, and the enlarged wall portion 140 are constructed of material that is compatible with molten metal 30 and molten electrolyte 32, typically cast iron.

FIG. 2 includes a sectional representation of the wall 10 of an electrolytic cell. The tapping of metal is normally performed near the wall 10. FIG. 2 further illustrates the possibility of having a crust of frozen electrolyte and alumina 27 (represented as a darker layer above the molten electrolyte 32), and frozen electrolyte 29, or "freeze", which may extend downwardly along the inclined wall 10 of the electrolytic cell and may also extend along the bottom cathode surface 20. This frozen electrolyte 29, if present along the wall 10 and the bottom cathode surface 20 of the electrolytic cell, may limit entry of the suction end 130 into the electrolytic cell and thereby influence the flow pattern around the pipe.

The pipe 110 as stated above includes a tubular wall 128 around the outside pipe periphery. In FIG. 2 the enlarged wall portion 140 consists of a block welded to the pipe 110 that defines a trailing edge 142 spaced from the bore 126 by a predetermined distance. The skilled person would understand that the rear portion 134 and the enlarged wall portion 140 may also be one constructed of one piece, or of "unitary construction".

The enlarged wall portion 140 extends along the pipe 110 from the suction end 130 a predetermined height 144, this distance is selected so that the enlarged wall portion will traverse the electrolyte/metal interface 31 boundary between the molten metal 30 and the molten electrolyte 32 during a tapping operation.

The internal bore 126 may in an illustrative embodiment be located centrally along the length of the pipe 110, where the length is defined from the vacuum end 120 to the suction end 130 along the pipe 110. It should be noted that during tapping of a particularly electrolytic cell the depth of metal will drop and the interface 31 will also drop. In an illustrative embodiment, metal is tapped from a location at a side wall of an electrolytic cell, where the suction end 120 of the pipe 110 is immersed in metal that is flowing generally in a tapping direction towards the side wall of the electrolytic cell and towards the crucible 50. The pipe 110 is oriented with the enlarged wall portion 140 oriented to extend in a direction downstream of the metal flow.

It is thought that by including an enlarged wall portion 140 at the suction end 128, the formation of vortices may be disrupted or displaced during metal tapping. These vortices may be responsible for the aspiration of molten electrolyte from the molten electrolyte/metal interface 31 into the metal 30 during taping. The enlarged wall portion 140 appears to be acting as a baffle which breaks, disrupts or diverts the flow pattern associated with vortex formation; this in turn appears to disrupt the entry of molten electrolyte into the molten metal during tapping. Thus, the enlarged wall portion 140 appears to hinder the aspiration of the electrolyte 32 into the metal 30 during tapping from the electrolyte/metal interface 31.

Figure 3:
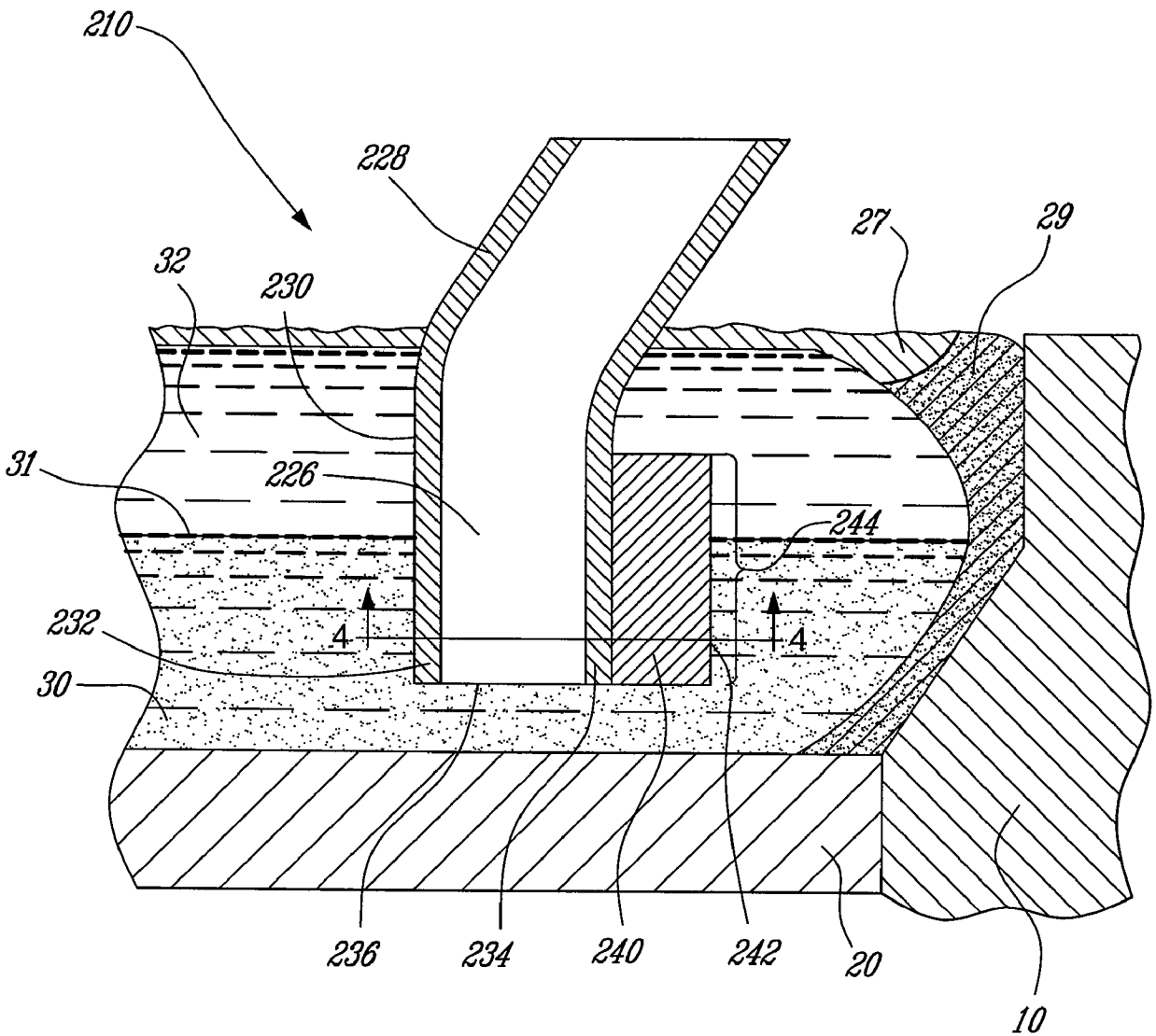
FIG. 3 is an enlarged sectional side view of the suction end of the apparatus according to a second embodiment of the present invention within an electrolytic cell schematically represented in cross section.

FIG. 3. illustrates a schematic side cross section of a second embodiment of the present invention. This embodiment comprises an elongate pipe 210 and its suction end 230 includes a substantially vertical pipe portion immersed through the electrolyte crust 27, and within the molten electrolyte 32 and molten metal 30. The tubular wall 228 of the embodiment shown in FIG. 3 is bent with a gentle bend, and is thus angled in the direction of an enlarged wall portion 240, and once again generally bent towards the tapping crucible 50, i.e. in the tapping direction. In this case the enlarged wall portion 240 extends radially outwardly from the pipe 210 and upwardly along the length of the pipe 210 so as to rise above the level of the bath/metal interface 31.

Figure 4A:
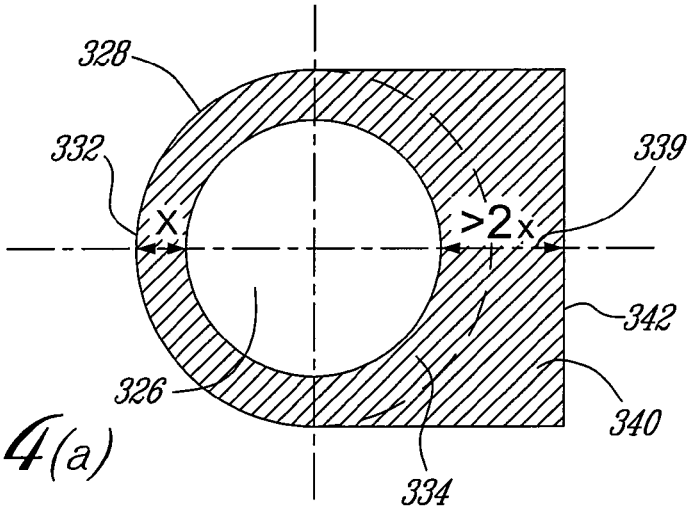
FIG. 4(*a*) represents a cross-sectional area of the operative end of the pipe along line 4-4 according to one embodiment of the present invention including a tubular wall having a wall thickness, x; and an enlarged wall portion having a breadth of that of the outer wall diameter and a width that is greater than 2x.
Figure 4B:
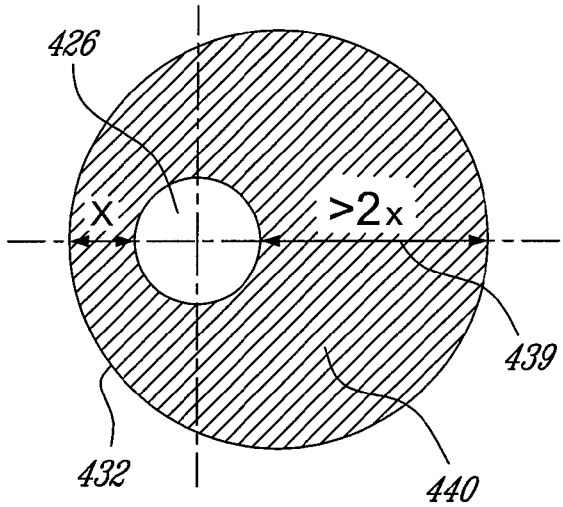
Figure 4C:
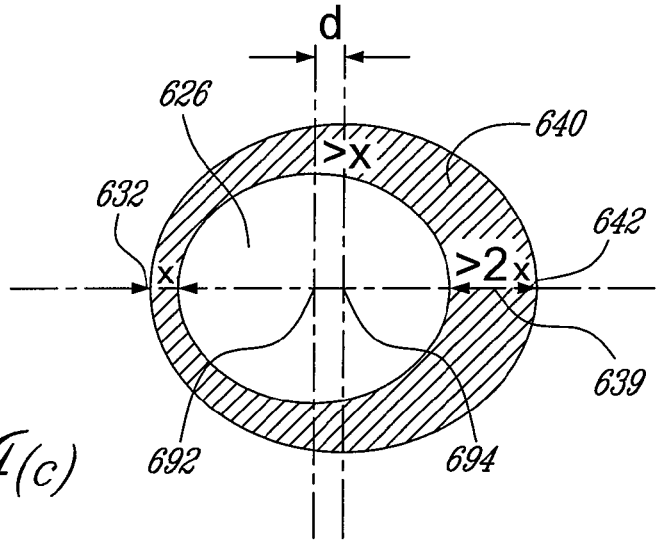

FIGS. 4(*a*)-(*d*) illustrate various possible cross-sections of a suction end 230 as may be found at the bottom 236 of the pipe 210 along line 4-4 in FIG. 3. Although not indicated on FIG. 2, similar cross-sections would be obtained if a dividing line similar to 4-4 were placed at the bottom of tapping pipe 136 in FIG. 2. These embodiments of the possible enlarged wall portions 240 may be, for example, attached to the rear portion 234, affixed as an extension to the bottom 236 of the operative end 230, or incorporated into the design of the pipe 210. For greater clarity, the reference numerals of the features represented in the figures, all share the last two digits but their numerical prefix varies. For example the "trailing edge" will always be identified with the numeral "_42", but in the various embodiments will be identified with the reference numbers: 142, 242, 342, etc.

FIG. 4(*a*) includes an enlarged wall portion 340 attached to or formed integrally with the wall 328 at a rear portion 334 for example by casting, such that the distance from the bore 326 to the trailing edge 342 defines a rear or second thickness 339, which is represented with an arrow in FIG. 4(*a*). The perimeter of the cross-sectional area of FIG. 4(*a*) is in the shape of a capital "D", rotated about a vertical axis while the bore has a circular cross-section and is spaced a greater distance from the trailing edge 342 than the front wall portion located opposite from the enlarged wall portion 340.

The rear or second thickness 339 in this embodiment is greater than 2 times the first thickness of the wall 328 (*x*) at the front wall portion 332. Further considering FIG. 4(*a*), the rear thickness 339 is defined along a major axis, while a minor axis intersects the major axis through the center of the bore 326. The wall thickness of the pipe 110 at the intersection of the minor axis, or the minor thickness, is in this embodiment the same as the thickness at the front wall (i.e. =x). The enlarged wall portion 340 has a width equal to the outer diameter of the pipe along the minor axis as shown in FIG. 4(*a*).

FIG. 4(*b*) shows a suction end 220 of the pipe 210 having a circular perimeter and includes an eccentric bore 426 of circular cross section positioned adjacent the front portion 432. The enlarged wall portion 440 has a rearwardly extending or second thickness 439 (defined by the arrow), that is at least 2 times greater than the wall thickness of the front portion 432.

FIG. 4(*c*) shows a pipe cross section at the suction end having an elliptical perimeter, a front wall portion 632, an enlarged wall portion 640, and a geometric pipe center 694. The pipe further defines an elliptical internal bore 626 having a bore center 692 on the major elliptical axis towards the front wall portion 632 and typically aligned with the tapping direction. In FIG. 4(*c*), the rear thickness 639 from the internal bore 626 to the trailing edge 642, which may also be called the second thickness 639, is at least twice the thickness at the front wall portion 632. It will be noted that the tubular wall thickness progresses gradually from the front wall portion 632 to the trailing edge 642. The dimension d, corresponds with the off-centering of the internal bore 626 within the pipe, and is specifically the distance between the center of the pipe 694 and the center of the internal bore 692.

Further embodiments of the proposed cross-sectional area of the suction end 230 along section 4-4 of FIG. 3 are found in FIGS. 4(*d*)(*i*) and (*ii*). These embodiments include: (respectively) an internal bore hole (726 and 826), preferably elliptically shaped; a front wall portion (732 and 832) having a forwardly facing projection and a first thickness in this embodiment greater than the wall thickness 828 at the intersection with the minor axis; and an enlarged wall portion (740 and 840) opposite the front wall portion (732 and 832). The enlarged wall portion (740 and 840) includes a rear or a second wall thickness, extending in the tapping direction from the internal bore (726 and 826) to the trailing edge (742 and 842). In FIG. 4(*d*)(*i*), the rear or the second thickness 739 of the enlarged wall portion 740 is at least 2 times greater than the first wall thickness of the front wall portion 732 and the rear width at the trailing edge 742 is substantially the same as the outer diameter of the tubular wall at the minor axis. In FIG. 4(*d*)(*ii*), the rear width at the trailing edge 842 is greater than the outer diameter of the tubular wall at the minor axis. Thus, the enlarged wall portion may extend radially outwardly from the pipe in more than one direction; in FIG. 4*d*(*ii*), for example, the enlarged wall portion extends radially outwards in a broad range of directions.

FIG. 4(*d*)(*ii*) includes walls 848 extending outwardly towards the trailing edge 842 that produce a suction end 220 that has a substantially triangular perimeter. FIG. 4(*d*)(*ii*) illustrates that the cross section of the operative end may also include chamfered corners 850 at the intersection of the trailing edge 842 and the extending walls 848. It should be noted that the embodiment depicted in FIG. 4(*d*)(*ii*) has rear or a second thickness 839 along the major axis of the ellipse from the central bore 826 to the towards the trailing edge 842 that need not be 2 times the dimension of the front projection 826 along the major axis of the ellipse, i.e. x. In an illustrative embodiment, when the rear width is greater than the outer diameter of the tubular wall and/or the front portion (732/832) includes a projection having a first wall thickness greater than the thickness of the wall (728/828) at the intersection of the minor axis with the wall, the second thickness (739/839) is preferably between 1.5 and 2.0 times the first wall thickness. In a preferred embodiment the second wall thickness is 1.5 times the first wall thickness, while in a particularly preferred embodiment the second wall thickness is 2.0 times the first wall thickness.

For greater clarity the width of any of the cross sectional shapes represented throughout, such as is represented in FIG. 4, is determined along a vertical axis perpendicular to a horizontal axis being in the tapping direction (and typically intersecting at the center of the bore 326) between the front portion 332 and the rear edge 342. The rear thickness 339 is understood to be defined from the internal bore 326 to the trailing edge 342 and is illustrated in FIG. 4(*a*) by the arrow identified as ">2x".

The skilled person would understand that the enlarged wall portion 140 may be enlarged rearwardly in the tapping direction to increase the "rear thickness" (or second thickness) of the operative end or enlarged "laterally" to increase the width of the operative end.

A method in accordance with an aspect of the present invention may include providing the inventive pipe apparatus and attaching it to a vacuum crucible 50 in such a way that there can be fluid communication of molten metal from the immersed suction end to the crucible or a similar molten metal receiver. Immersing the operative end into the metal, it may be necessary that the crust 27 on the surface of the electrolyte be broken. Here the enlarged wall portion (such as 140) may be used to help break the crust 27. The bottom of the pipe is passed through the layer of molten electrolyte 32 into the molten metal 30. The operative end of the pipe may be oriented to the extent possible with the enlarged wall portion extending in the tapping direction towards the crucible and in generally the direction of the molten metal flow within the electrolytic cell. When vacuum is applied in the molten metal receiver, it is believed that a flow pattern about the immersed operative end is established, and may be influenced by the flow of molten metal in the electrolytic cell and due to the tapping flow towards the molten metal receiver. The enlarged wall portion is believed to divert and/or disrupt the formation of vortices in the molten metal flow during tapping. These vortices may be produced in the molten metal at the enlarged wall portion of the operative end, at a point further towards the tapping direction. This diversion/disruption is believed to reduce the amount of electrolyte drawn downward from the molten electrolyte/metal interface 31, thus the enlarged wall portion can act like a baffle which disrupts the formation of vortices which would otherwise aspirate electrolyte into the molten metal during tapping.

EXAMPLES

All the tests presented below were carried out in full sized commercial cells operating in a side-by-side configuration and operating at approximately 200 K-amps current. Metal was removed at a first end of the cell, where model calculations indicated that the metal was expected to be flowing generally towards the first end of the cell. The average velocity of the metal flow is estimated at approximately 10 cm/s. The examples compared the performance of metal removed using: 1) a conventional tapping pipe, and 2) an inventive tapping pipe modified in accordance with aspects of the present invention. The inventive tapping pipe used was very similar to that illustrated in FIG. 3 with an enlarged wall section 240 having a height that was above the interface 31 but below the crust 27.

Example 1

The amount of electrolyte residue tapped per tonne of metal (kg/tonne) was determined for a number of tapping runs on several different cells of the above type. The results were plotted versus the actual rate of metal removal (kg/s). The performance of the conventional tapping pipe and the inventive tapping pipe were compared. Each of the tapping pipes was immersed into the layer of molten metal 30 by breaking through the crust 27 and passing through the molten electrolyte 32. Once within the molten metal 30 a negative pressure or vacuum pressure is applied which was sufficient to aspirate the molten metal up through the bore of the tapping pipe into the crucible. To vary the mass flowrates of tapped metal through the bore of the tapping pipe the vacuum pressure is either increased or decreased.

Figure 5A:
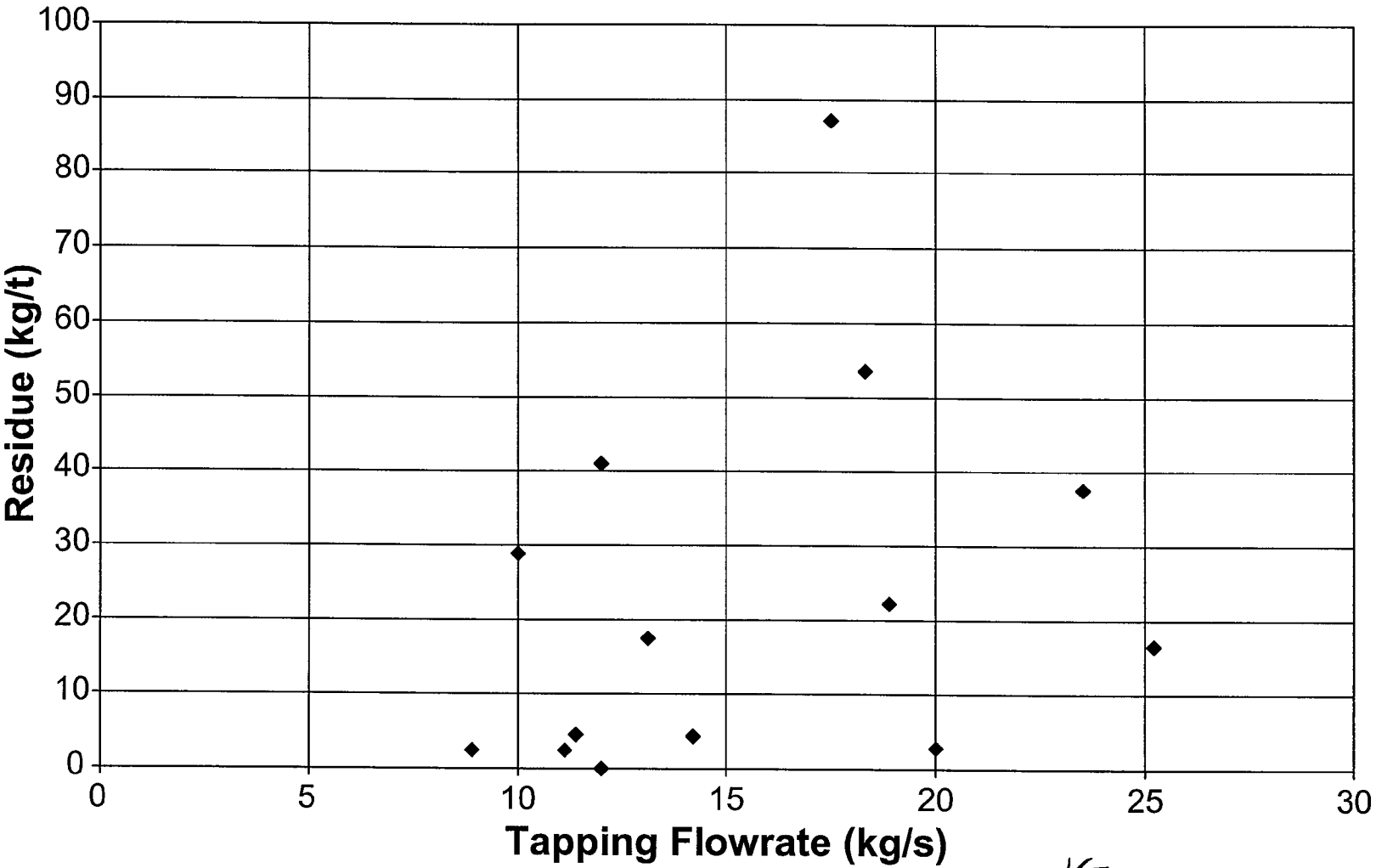
Fig. 5a (PRIOR ART)
FIG. 5(*a*) is a graph of the amount of the electrolyte residue entrained (kg/tonne) at various metal tapping flowrates using a tapping pipe of the prior art (without an enlarged wall portion)
Figure 5B:
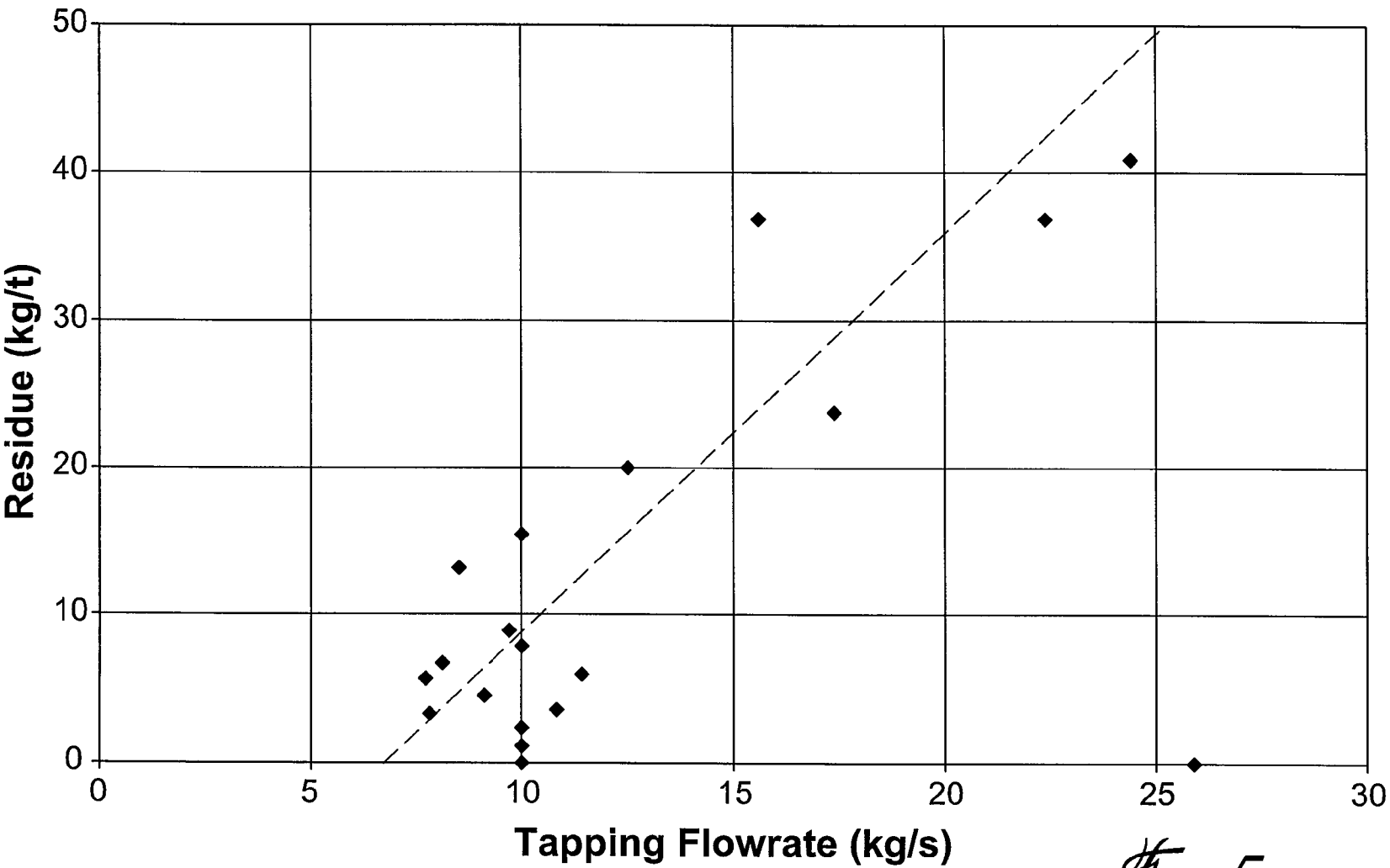

In the attached FIGS. 5(*a*) and 5(*b*) it can be appreciated that for a conventional tapping pipe the residue quantities were generally scattered and higher than the ones using the inventive tapping pipe. Importantly, results with the inventive tapping pipe illustrated in FIG. 5(*b*) indicated that the amount of electrolyte residue versus tapping flowrate gave a good linear correlation, indicating that the level of residue tapped per tonne of metal was rendered more predictable and controllable. As can be appreciated, this can allow for improved planning of maintenance as well as providing the ability to better estimate the amount of residue that will be included in the tapped metal. Each point of those curves corresponds to four cells tapped.

Example 2

In comparing the results obtained with both kind of tapping pipes (inventive and conventional), it can noted that for a tapping mass flow rate varying between 10 and 15 kg/s, the mass of residue has been decreased in using the inventive pipe. With this pipe, the mass of residue varies between 0 to 20 kg/tonne while with conventional pipe, the mass of residue varies between 0 and 40 kg/tonne.

Example 3

Figure 6:
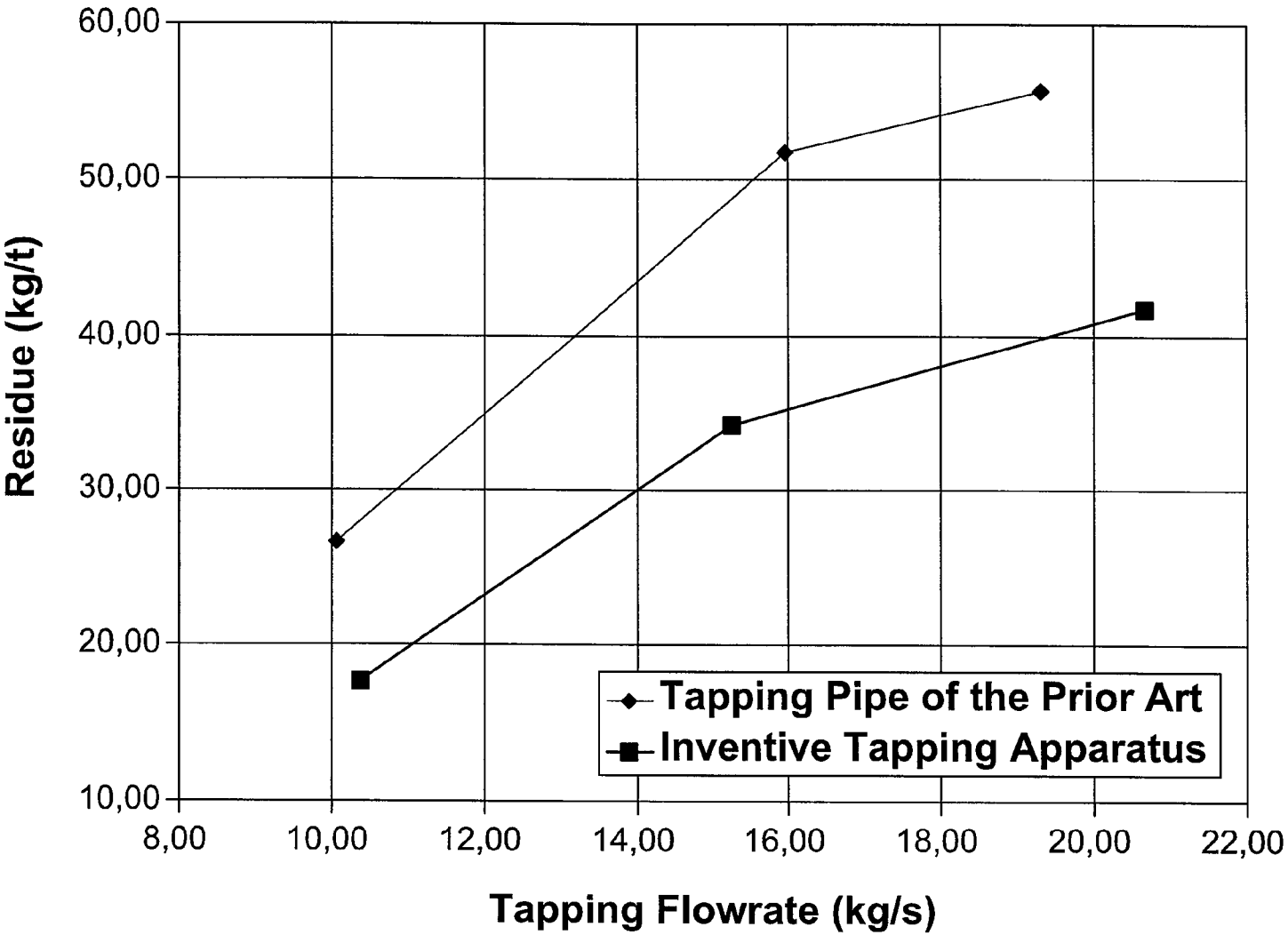

Average residue levels were determined for three different tapping rates on a number of cells for both the conventional and the inventive tapping pipe designs. These are plotted in FIG. 6 and represented in Table 1. The results indicate that for all compared metal tapping rates, the tested tapping pipe based on the inventive design withdraws less electrolyte than the conventional tapping pipe. For example, based on FIG. 6, a tapping pipe based on the present invention may allow a flowrate increase of about 45 percent when a residue rate of about 40 kg/ton is obtained. Table 1 illustrates that an average reduction of between 25 to 33% in the quantity of electrolyte carry-over during tapping can be achieved with inventive tapping pipe of the present invention at various tapping rates.

TABLE 1

| Tapping Apparatus | Average Tapping Flowrate (kg/s) | Electrolyte Residue in the metal tapped (kg/tonne) |
|---|---|---|
| Tapping pipe of the prior Art | 10.07 | 26.70 |
| | 15.95 | 51.68 |
| | 19.32 | 55.65 |
| Inventive Tapping design of an aspect of the present invention | 10.38 | 17.71 |
| | 15.24 | 34.26 |
| | 20.67 | 41.68 |

Table 1 indicates that for an average tapping flowrate of up to 10 kg/s the mass of electrolyte per metal tapped is less than 18 kg/tonne. While at higher average tapping flowrates (kg/s) the electrolyte/metal ratio tapped is: less than 35 kg/tonne for an average tapping flowrate of up to 15 kg/s, and less than 42 kg/tonne electrolyte per metal tapped when the average tapping flowrate is up to 21 kg/s. These specific values are illustrative of the cells used for the tests, which were operating at 200 K-amps, and actual results will depend on the actual operating parameters of the electrolytic cell from which the metal is tapped.

The embodiments of the invention described above are intended to be exemplary only. The scope of the invention is therefore intended to be limited solely by the scope of the appended claims.

The invention claimed is:

1. An apparatus for tapping molten metal from below a molten electrolyte less dense than the molten metal, the molten metal and the molten electrolyte forming a boundary at an electrolyte/metal interface, the apparatus comprising:

a pipe having a first end and a second end opposite the first end, the second end adapted for immersion into the molten metal, the pipe defining an internal bore extending along a length thereof between the first end and the second end, the internal bore for passage of molten metal therethrough, the pipe having an enlarged wall portion proximate the second end, the enlarged wall portion extending radially outwardly from the bore in at least one direction and extending axially away from the second end a predetermined distance, the pipe having a front wall portion proximate the second end, said front wall portion being opposite the enlarged wall portion, the front wall portion having a first wall thickness, the first wall thickness being defined from the internal bore to a leading edge, the enlarged wall portion having a second wall thickness greater than the first wall thickness, the second wall thickness being defined from the internal bore to a trailing edge and wherein the second wall thickness is greater than 1.5 times the first wall thickness, whereby during tapping the enlarged wall portion traverses the electrolyte/metal interface and defines an obstacle to limit entrainment of electrolyte into the pipe.

2. The apparatus according to claim 1, wherein the second wall thickness is greater than 2 times the first wall thickness.

3. The apparatus according to claim 1, wherein the second end of the pipe in cross-section has an elliptical perimeter defining a major and a minor axis.

4. The apparatus according to claim 3, wherein the internal bore is positioned off-centered along the major axis.

5. The apparatus according to claim 1, wherein the trailing edge of the enlarged wall portion defines a straight edge.

6. The apparatus according to claim 1, wherein the enlarged wall portion in cross-section defines a substantially triangular perimeter.

7. The apparatus according to claim 1, wherein the second end of the pipe in cross-section has a circular perimeter.

8. The apparatus according to claim 7, wherein the internal bore is eccentrically adjacent the front wall portion.

9. The apparatus according to claim 1, the front wall portion comprises a forwardly facing projection, and the enlarged wall portion defining a rear width at the trailing edge, the second wall thickness being between 1.5 to 2 times the first wall thickness.

10. The apparatus according to claim 9, wherein the trailing edge of the enlarged wall portion defines a straight edge.

11. The apparatus according to claim 10, wherein the enlarged wall portion in cross-section defines a substantially triangular perimeter.

* * * * *